US005473986A

United States Patent [19]

Hau

[11] Patent Number: 5,473,986

[45] Date of Patent: Dec. 12, 1995

[54] FUSE FOR A PROJECTILE

[75] Inventor: Heinz Hau, Erlensee, Germany

[73] Assignee: Honeywell A.G., Germany

[21] Appl. No.: 159,274

[22] Filed: Nov. 30, 1993

[30] Foreign Application Priority Data

Dec. 1, 1992 [DE] Germany ..... 42 40 263.8

[51] Int. Cl.[6] ..... F42C 11/06

[52] U.S. Cl. ..... 102/206; 102/215

[58] Field of Search ..... 102/200, 206, 102/215; 361/248

[56] References Cited

U.S. PATENT DOCUMENTS 4,615,268 10/1986 Nakano et al. ..... 102/217

4,632,031 12/1986 Jarrott et al. ..... 102/200

4,750,424 6/1988 Hau ..... 102/200

*Primary Examiner*—Ian J. Lobo

*Attorney, Agent, or Firm*—Robert B. Leonard

[57] ABSTRACT

A programmable fuse for a projectile is supplied with voltage during the programming phase by rectifying the inductively transmitted program information. The program information is laid down via a microprocessor (U3) within a non-volatile memory (U4). With the created supply voltage a capacitor C1 is charged. This capacitor is discharged by means of a resistor (R3) and a gate (U2A) into an input (PAO) of the microprocessor (U3). The program information of the non-volatile memory (U4) only can be read only in the event where at launching of the fuse and at activating of a battery ($U_B$), the predetermined input (PAO) of the microprocessor (U3) shows a predetermined potential ("0").

8 Claims, 2 Drawing Sheets

FUSE FOR A PROJECTILE

BACKGROUND OF THE INVENTION

The present invention relates to a fuse for projectiles. Fuses for projectiles are well known in the art. Such a fuse is known from German patent 36 07 372. In this patent, a primary battery was provided for supplying the fuse electronics during programming At the same time, the primary battery was feeding a digital display for the programmed running time. The running time was stored within a random access memory and could be changed by an override-program as long as the fuse electronics were being supplied by the primary battery.

Further, it was known from German patent 34 42 390, to load an ignition capacitor by rectifying the electromagnetic waves produced by an oscillating unit and received within an oscillatory circuit. A release circuit produces an ignition pulse from the charge of the ignition capacitor at the absence of the electromagnetic waves. A time setting, or an operation with different functions of the fuse, is not provided. Often, it was required for fuses to have multiple functions, i.e., the fuse had to be able to operate as a time fuse, a proximity fuse or an impact fuse. However, it would happen occasionally that due to a changed fire command, a programmed running time became invalid because an impact function is required.

It is, therefore, the object of the present invention to design a fuse of the above indicated type, in such a way that after the expiration of a predetermined time interval, a changed fire command is executed and a programmed running time is ignored.

SUMMARY OF THE INVENTION

The object of this present invention is achieved according to the features of claim 1. Further advantageous embodiments of the inventive fuse may be taken from the dependent claims.

A programmable fuse for a projectile is supplied with voltage during the programming of a microprocessor (U3) by rectifying inductively transmitted program information. The program information is laid down via the microprocessor within a non-volatile memory (U4). With the created supply voltage, a capacitor C1 is charged. This capacitor is discharged by means of a resistor (R3) and a gate (U2A) into an input (PAO) of the microprocessor. The program information of the nonvolatile memory only can be read only when at launching of the fuse and at activation of a battery ($U_B$), the predetermined input of the microprocessor shows a predetermined potential.

BRIEF DESCRIPTION OF THE DRAWINGS

The FIGURES of the drawing are a block diagram of the present invention.

DETAILED DESCRIPTION OF THE PREFERRED EMBODIMENT

Figure 1A:
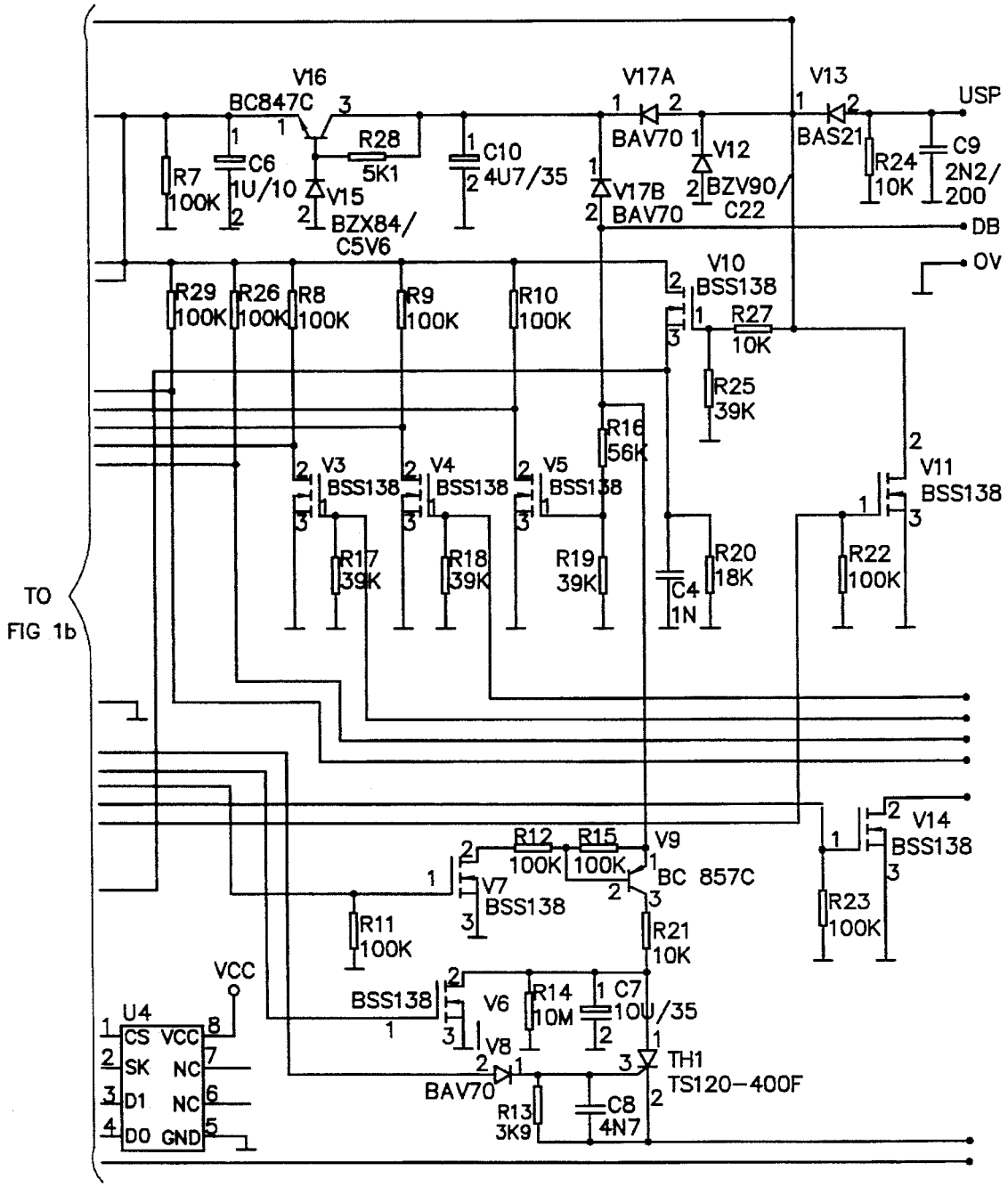
Figure 1B:
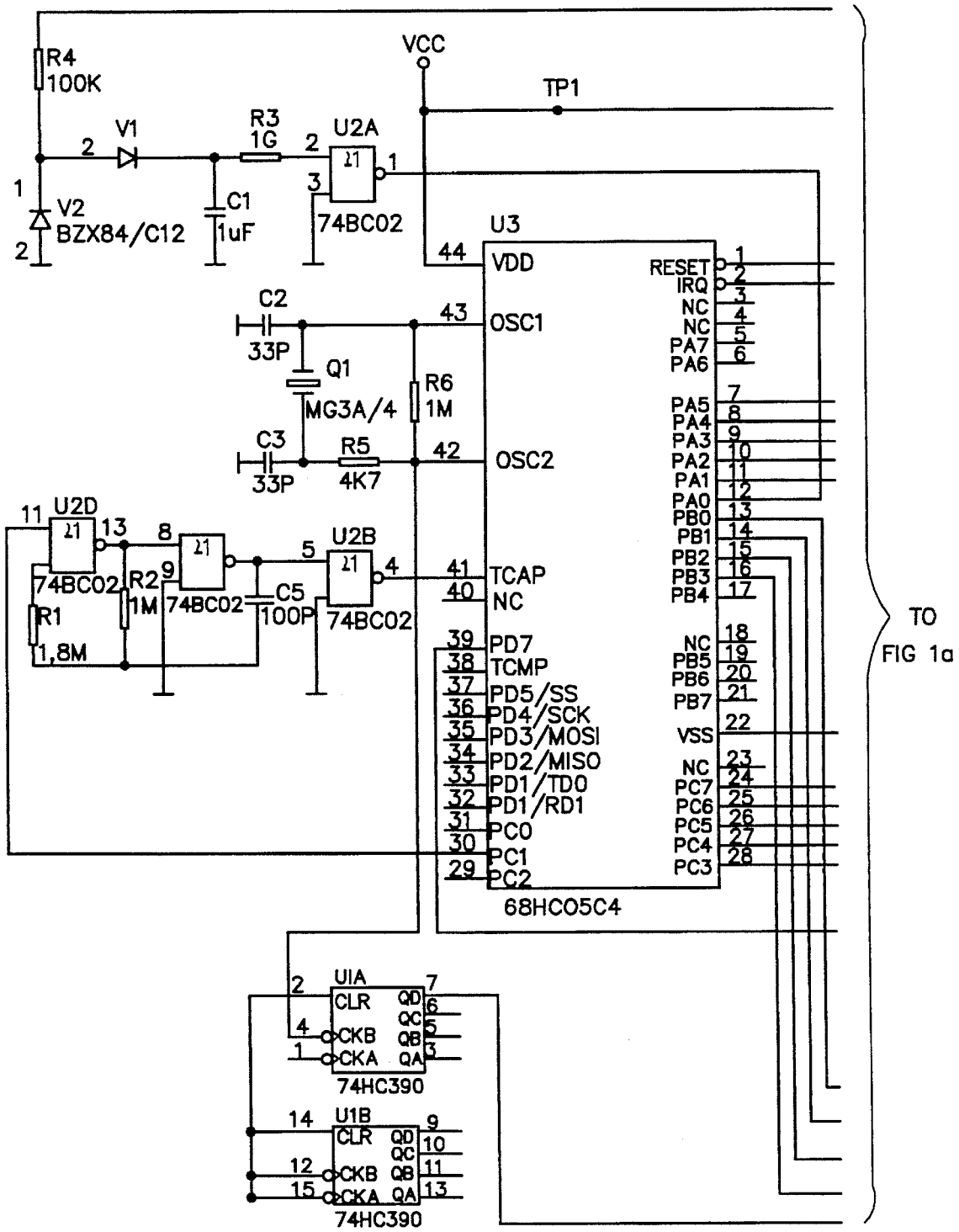

With respect to the figures, an embodiment of the fuse shall be further described where only those elements of the circuit device which are of importance in achieving the object of the invention are described.

By means of a receiving coil (not shown) connected to terminals USP and V, which, together with a capacitor C9 and a resistor R24, forms an oscillating circuit, all of the electronics are supplied with a voltage during the programming of microprocessor U3. For this purpose, the induced AC voltage is rectified by a serial diode V13, and the DC voltage arising in point A of the circuit is limited to 22 V by means of a Zener diode V12.

The supply voltage $V_{CC}$ for the microprocessor U3 and a non-volatile memory, EEPROM U4 is formed by means of a longitudinal controller which comprises a transistor V16, diodes V15 and V17A, capacitors C6 and C10 and resistors R7 and R28. In the event the battery is activated at launching of the projectile fuse, the battery voltage $U_B$ is connected to the longitudinal controller via a diode V17B.

The voltage which arises during programming of the microprocessor in point A also charges a foil condenser C1 via a resistor R4 and a diode V1. The voltage across the condenser C1 is limited to 12 V by means of the Zener diode V2, arranged in parallel.

Further, the control electrode of a field effect transistor V10 is supplied with the programming information available in point A, via the voltage divider, consisting of the resistors R25, R27, with the drain electrode of transistor V10 delivering the program information to the input PD7 (port 39) of the microprocessor U3. From the outputs PB0-PB3 (ports 13–16), the program information is written into the EEPROM U4. During programming, by means of cyclically controlling the field effect transistor V11 from the output PC3 (port 28) of the microprocessor U3, the point A (and, therefore, also the coil) connected to USP, is grounded so that the received flight data are transmitted to a programming apparatus (not shown), which is well known in the art.

After the programming has been finished, the electronics are disconnected from the voltage, and the foil condenser C1 may discharge via a resistor R3 and the protecting diodes of a negating AND-gate U2A.

The time constant of the timing circuits C1, R3, U2A is chosen in such a way that the foil condenser C1 is discharged after a minimum of 20 minutes and a maximum of 40 minutes at maximum.

At the end of the programming the foil condenser C1 is charged to 12 V, and the negating AND-gate U2A delivers at its output a signal with a value "0". One input of the negating AND-gate is at a level with the value "1", whereas the other input of the gate shows permanently the value "0". The negating AND-gate U2A produce a signal with a value "1" only where the foil condenser C1 is discharged after 20 minutes minimum or 40 minutes maximum both, inputs of the gate U2A show a level "0". The output of the gate U2A is connected to the input PA0 (port 12) of the microprocessor U3.

If, at any point of time, the fuse is launched and then the battery $U_B$ is activated, the electronics are supplied with energy. At the same time, the microprocessor U3, after its initialization, interrogates the input PA0 (port 12), and only where this input shows the level "0" is the flight data, stored within the nonvolatile memory EEPROM U4, evaluated as valid data.

If, however, the input PA0 (port 12) shows a signal with a value "1", then the flight data within memory EEPROM U4 are not evaluated.

This procedure is equivalent to the clearing of the data within the memory EEPROM. Such a clearing of data is not possible when the fire command has changed at the launching after 40 minutes after programming, due to the lack of a power supply.

However, a new programming clears the data which are present in memory EEPROM where the new data are stored in memory, and the procedure as described before, starts again.

I claim:

1. A fuse for a projectile, comprising:

an ignition circuit including a microprocessor and a circuit arrangement for inductively transmitting information to the fuse during a programming phase, the ignition circuit being supplied with energy during the programming phase by rectifying inductively transmitted information;

a battery actuable only at the launching of the projectile;

energy storage means connected to the microprocessor, said energy storage means being charged during the programming phase; and non-volatile memory connected to the microprocessor, the non-volatile memory storing said program information, said non-volatile memory being inhibited from a read-out operation in an event where the energy storage means is discharged through a discharge circuit.

2. The Fuse according to claim 1, wherein: the non-volatile memory is an EEPROM.

3. The Fuse according to claim 1, wherein:

the discharge circuit comprises a negating AND-gate having and first and second terminals and a resistor, said first terminal being connected to ground and said second terminal being connected to the energy storage means via the resistor.

4. The Fuse according to claim 1, wherein:

the microprocessor is programmed such that it reads the program information from the non-volatile memory only in the event where an input shows a predetermined potential of "0".

5. The Fuse according to claim 1, wherein: the storage means consists of a foil condenser.

6. The Fuse according to claim 1, wherein: the energy storage means and the discharge circuit jointly comprise a timing circuit a time constant of 20 to 40 minutes.

7. A method for arming a Fuse for a projectile, the fuse having an ignition circuit connected to a battery, the ignition circuit including a microprocessor, a non-volatile memory, a storing means, a discharge circuit and a programming circuit for programming of the fuse during a programming phase using a programming signal to convey program information, comprising the steps of:

actuating the battery at the launching of the projectile;

energizing the ignition circuit during the programming phase with energy supplied by rectifying the programming signal;

storing said program information in a non-volatile memory charging the storing means during the programming phase;

inhibiting readout of the non-volatile memory if said storing means is discharged; and causing readout of the non-volatile memory to the microprocessor otherwise, via the discharge circuit.

8. The method of claim 7, comprising the further step of:

programming the microprocessor such that it reads only the program information from the non-volatile memory in the event where a predetermined input terminal of the microprocessor is at a predetermined electrical potential.

* * * * *